United States Patent [19]

Budzich

[11] 4,437,388

[45] * Mar. 20, 1984

[54] DUAL INPUT PRESSURE COMPENSATED FLUID CONTROL VALVE

[75] Inventor: Tadeusz Budzich, Moreland Hills, Ohio

[73] Assignee: Caterpillar Tractor Company, Peoria, Ill.

[ * ] Notice: The portion of the term of this patent subsequent to Mar. 13, 2001 has been disclaimed.

[21] Appl. No.: 294,605

[22] Filed: Aug. 20, 1981

[51] Int. Cl.³ ..... F15B 13/04

[52] U.S. Cl. ..... 91/446; 91/421; 137/596.1; 137/596.13; 251/133

[58] Field of Search ..... 91/421, 446; 137/596.1, 137/596.13; 251/133, 134

[56] References Cited

U.S. PATENT DOCUMENTS

| | | | |
|---|---|---|---|
| Re. 29,538 | 2/1978 | Budzich | 137/596.1 X |
| 3,488,030 | 1/1970 | Hulme et al. | 251/134 |
| 3,756,282 | 9/1973 | Knutson | 251/133 X |
| 3,839,662 | 10/1974 | N'Guyen Van | 251/134 |
| 4,031,811 | 6/1977 | Inaba et al. | 91/380 X |
| 4,145,956 | 3/1979 | Rumrill et al. | 137/625.64 X |
| 4,190,081 | 2/1980 | Coles | 137/625.65 X |
| 4,235,156 | 11/1980 | Olsen | 91/363 R |
| 4,327,627 | 5/1982 | Budzich | 137/596.13 X |
| 4,333,389 | 6/1982 | Budzich | 137/596.1 X |

*Primary Examiner*—Gerald A. Michalsky

*Attorney, Agent, or Firm*—Sixbey, Friedman & Leedom

[57] ABSTRACT

A dual input direction flow control valve responsive to a manual or an electrical control signal for control of positive and negative loads operated by a single pilot valve stage, which automatically maintains a relatively constant pressure differential across valve spool, while controlling positive and negative loads and which permits variation in the level of pressure differential in response to a pulse type control signal, while this pressure differential is maintained constant at each controlled level.

16 Claims, 1 Drawing Figure

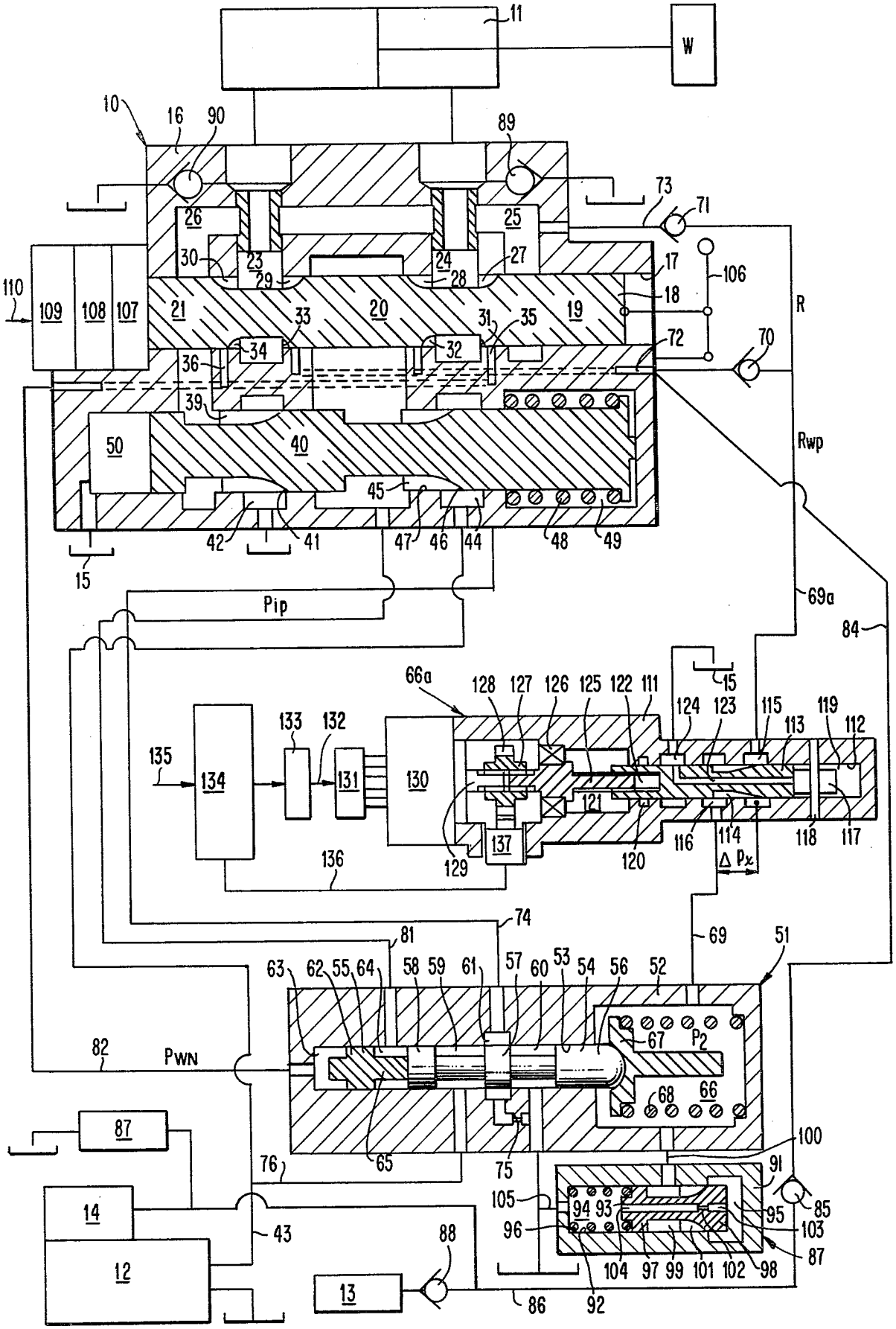
W
Pip
Rwp
R
Pwn
Δ Px
P2

DUAL INPUT PRESSURE COMPENSATED FLUID CONTROL VALVE

BACKGROUND OF THE INVENTION

This invention relates generally to fluid control valves provided with positive and negative load compensation.

In more particular aspects this invention relates to pressure compensated direction and flow control valves, the positive and negative load compensators of which are controlled by a single amplifying pilot valve stage.

In still more particular aspects this invention relates to pilot operated pressure compensated controls of direction control valves, used in control of positive and negative load, which permit variation in the level of control differential across metering orifices of the valve spool, while this control differential is automatically maintained constant at each controlled level.

In still more particular aspects this invention relates to pilot operated pressure compensated controls of direction control valves responsive to a manual and an electrical control signal, for control of positive and negative loads, which permit variation in the controlled pressure differential, across metering orifices of the valve spool, in response to an external pulse type control signal.

Closed center fluid control valves, pressure compensated for control of positive and negative loads, are desirable for a number of reasons. They permit load control with reduced power losses and therefore, increased system efficiency. They also permit simultaneous proportional control of multiple positive and negative loads. Such fluid control valves are shown in my U.S. Pat. No. 4,180,098, issued Dec. 5, 1979 and also in my U.S. Pat. No. 4,222,409 issued Sept. 16, 1980. However, the valves of those patents although capable of proportional control of positive and negative loads, use for such control the energy directly transmitted through the load pressure sensing ports, which not only attenuate the control signals, but limit the response of the control. Those valves also automatically maintain a constant pressure differential across metering orifices in control of both positive and negative loads.

SUMMARY OF THE INVENTION

It is therefore a principle object of this invention to provide an improved pressure compensated valve responsive to an electrical control signal, equipped for positive and negative load compensation, in which the positive and negative load compensator is controlled by a single amplifying pilot valve stage, which permits variation in the level of control differential across metering orifices of the valve spool, while this control differential is automatically maintained constant at each controlled level.

Another object of this invention is to provide pilot operated pressure compensated controls of a direction control valve responsive to a manual or electrical control signal, through which control of system positive or negative load can be either accomplished by variation in areas of the orifices between the valve controls and the fluid motor in response to a manual input, while the pressure differential across those orifices is maintained constant at a specific level, or by control of pressure differential, acting across those orifices, while the area of those orifices remains constant in response to an electrical pulse type signal transmitted to a digital actuator.

It is a further object of this invention to provide pilot operated pressure compensated controls of a direction control valve responsive to a manual and electrical control signal, adapted to control both positive and negative loads, which permit variation in the controlled pressure differential, across metering orifices, in response to the pulse type control signal.

Briefly the foregoing and other additional objects and advantages of this invention are accomplished by providing novel pressure compensated controls of a direction control valve responsive to a manual and electrical control signal, to throttle fluid supplied either from the pump or from the fluid motor, either in response to one manual or electrical control input, namely variation in the area of metering orifices, to control a constant pressure differential, at a preselected level developed across those orifices, or in response to another electrical pulse type control input, namely modification in the pressure of control signals, to vary the level of the control differential developed across the control orifices, while this control differential is automatically maintained constant at each controlled level by the valve controls, receiving low energy control signals to their amplifying stage. In this way a load can be controlled in response to either input, providing identical control performance, or the variable pressure differential control can be superimposed on the control action controlling a positive or negative load by variation in the areas of the metering orifices. Therefore this control system lends itself well to an application in which manual or electrical control input from an operator may be directly modified by an electronic computing circuit.

Additional objects of this invention will become apparent when referring to the preferred embodiments of the invention as shown in the accompanying drawings and described in the following detailed description.

DESCRIPTION OF THE DRAWING

The single FIGURE is a sectional view of an embodiment of a flow control valve provided with a single positive and negative load compensator, also showing a longitudinal sectional view of an embodiment of a pilot valve amplifying stage controlling the compensator and longitudinal sectional view of a control signal modifying control responsive to an electrical pulse type signal, with fluid motor, system pump and other system valves shown schematically.

DESCRIPTION OF THE PREFERRED EMBODIMENT

Referring now to the drawing, an embodiment of a flow control valve, generally designated as 10, is shown interposed between diagrammatically shown fluid motor 11 driving load W and a pump 12, of a fixed displacement or variable displacement type, driven by a prime mover, not shown. Fluid flow from the pump 12 to flow control valve 10 and a circuit of diagrammatically shown flow control valve 13 regulated by pump flow control 14. If pump 12 is of a fixed displacement type, pump flow control 14 is a differential pressure relief valve, which, in a well known manner, by bypassing fluid from pump 12 to a reservoir 15, maintains discharge pressure of pump 12 at a level, higher by a constant pressure differential, than load pressure developed in fluid motor 11. If pump 12 is of a variable displacement type, pump flow control 14 is a differential pressure compensator, well known in the art, which by changing displacement of pump 12, maintains discharge pressure of pump 12 at a level, higher by a constant pressure differential, than load pressure developed in fluid motor 11.

The pump flow control 14 may also be a maximum pressure compensator or relief valve, which maintains the discharge pressure of the pump 12 at a maximum constant pressure level during operation of the system.

The flow control valve 10 is of a four way type and has a housing 16 provided with a bore 17, axially guiding a valve spool 18. The valve spool 18 is equipped with lands 19, 20 and 21, which in neutral position of the valve spool 18, as shown in the drawing isolate a fluid supply chamber 22, load chambers 23 and 24 and outlet chambers 25 and 26. Lands 19, 20 and 21, of valve spool 18, are provided with metering slots 27, 28, 29 and 30 and signal slots 31, 32, 33 and 34. Negative load sensing ports 35 and 36 are positioned between load chambers 23 and 24 and outlet chambers 26 and 25. Positive load sensing ports 37 and 38 are located between supply chamber 22 and load chamber 23 and 24. Negative load throttling slots 39, of control spool 40, equipped with throttling edges 41, connect outlet chambers 26 and 25 with an exhaust chamber 42, which in turn is connected to reservoir 15.

The pump 12, through its discharge line 43, is connected to an inlet chamber 44. The inlet chamber 44 is connected through positive load throttling slots 45, on control spool 40, provided with throttling edges 46, with the fluid supply chamber 22. Bore 47 axially guides the control spool 40, which is biased by control spring 48, contained in control space 49, towards position as shown. The control spool 40 at one end projects into control space 49, the other end projecting into chamber 50, connected to the reservoir 15. A pilot valve assembly, generally designated as 51, comprises a housing 52, provided with a bore 53, slidably guiding pilot valve spool 54 and free floating piston 55. The pilot valve spool 54 is provided with lands 56, 57 and 58, defining annular spaces 59 and 60. Annular space 61 is provided within the housing 52 and communicates directly with bore 53. The free floating piston 55 is provided with a land 62, which defines annular spaces 63 and 64 and is provided with extension 65, selectively engageable with land 58 of the pilot valve spool 54. The pilot valve spool 54 at one end projects into control space 66 and engages, with its land 56 and spring retainer 67, a pilot valve spring 68. Control space 66 communicates through line 69 and a controller, generally designated as **66*a*, and through line 69*a* with check valves 70 and 71. The check valve 70 is connected by passage 72 with positive load sensing ports 37 and 38. The check valve 71 communicates through line 73 with the outlet chamber 25. Annular space 61, of the pilot valve assembly 51, communicates through line 74 with control space 49 and also communicates, through leakage orifice 75, with annular space 60, which in turn is connected to reservoir 15. Annular space 59 communicates through line 76 with discharge line 43. Annular space 64 is connected by line 81 with the supply chamber 22. Annular space 63 is connected by line 82 and passage 83 with negative load sensing ports 36 and 35. Positive load sensing ports 37 and 38 are connected through passage 72, line 84 and a check valve 85 and a signal line 86 with the pump flow control 14. Control space 66 is connected through a flow control, generally designated as 87, with the reservoir 15. Flow control 87 is a flow control device, passing a constant flow from control space 66 to the reservoir 15. The load chambers 23 and 24 are connected, for one way fluid flow by check valves 89 and 90, to schematically shown system reservoir, which also might be a pressurized exhaust manifold of the entire control system, as shown in the drawing. The flow control, generally designated as 87, is interposed between control space 66 and the system reservoir 15 and comprises a housing 91, provided with a bore 92, guiding a flow control spool 93, which defines spaces 94 and 95 and which is biased by a spring 96. The flow control spool 93 is provided with lands 97 and 98, defining annular space 99, which is connected by line 100 with control space 66. The flow control spool 93 is also provided with throttling slots 101 and leakage orifice 102, which communicates through passages 103 and 104, space 95 with space 94, space 94 being connected by line 105 with system reservoir 15**.

The valve spool 18 at one end is connected to a manual lever 106, while at the other end it is connected, through a lost motion mechanism 107, to a digital pulse type actuator 108, which can be composed of a stepper motor-lead screw combination, provided with a fluid power amplifier. The electrical power to the stepper motor is supplied by a solid state logic switch 109, which responds to a pulse type low energy electrical signal 110.

The controller, generally designated as **66*a*, is interposed between control space 66 and the logic system of check valves 70 and 71 and comprises a housing 111, provided with bore 112, slidably guiding a metering spool 113. The metering spool 113 is provided with metering slots 114, regulating fluid flow between annular spaces 115 and 116. One slotted end 117, of the metering spool 113, engages antirotation pin 118, passing through space 119, while the other end, suitably sealed by a seal 120, projects into space 121 and is provided with a threaded bore 122. The metering spool 113 is also provided with passage 123, connecting space 119 with annular space 124, which is in turn connected to system reservoir 15. A threaded shaft 125, journalled in bearing 126, with one end engages threaded bore 122 of the metering spool 113, while engaging with other splined end a coupling 127, provided with gear teeth 128. The coupling 127 drivingly connects the threaded shaft 125 with a drive shaft 129, of a stepper motor 130. The stepper motor 130 is controlled by a solid state logic switch 131, provided with pulse type control signal 132 from a pulse generator 133, which in turn is controlled by a micro-processor or a micro-computer 134, provided with an input signal 135 and through line 136, a pulse type feedback signal from a pulse pick-up 137**.

The preferable sequencing of lands and slots of valve spool 18 is such, that when displaced in either direction from its neutral position, as shown in the drawing, one of the load chambers 23 or 24 is connected by signal slot 32 or 33 to the positive load sensing port 37 or 38, while the other load chamber is simultaneously connected by signal slot 31 or 34 with negative load sensing port 35 or 36, the load chamber 23 or 24 still being isolated from the supply chamber 22 and outlet chambers 25 and 26. Further displacement of valve spool 18 from its neutral position connects load chamber 23 or 24 through metering slot 28 or 29 with the supply chamber 22, while simultaneously connecting the other load chamber through metering slot 27 or 30 with outlet chamber 25 or 26.

As previously described the pump flow control 14, in a well known manner, will regulate fluid flow, delivered from pump 12, to discharge line 43, to maintain the pressure in discharge line 43 higher, by a constant pressure differential, than the highest load pressure signal transmitted through the check valve system to signal line 86. Therefore, with the valve spool 18, of flow control valve 10, in its neutral position blocking positive load sensing ports 37 and 38, signal pressure input to pump flow control 14 from signal line 86 will be at minimum pressure level, corresponding with the minimum standby pressure of the pump 12.

As shown in the drawing, the flow control valve 10 is interposed between a schematically shown pump 12 and the fluid motor 11. The pilot valve assembly 51, in a manner as will be described later in the text, regulates the position of the control spool 40 to control the pressure differential ΔPyp developed across orifices created by displacement of metering slots 28 and 29 and to control the pressure differential ΔPyn, across orifices created by displacement of metering slots 27 and 30. Control space 66 of the pilot valve assembly 51 is connected to the system reservoir 15 by the flow control, generally designated as 87, which is a constant flow device, passing a constant flow of fluid from control space 66 to the reservoir 15, irrespective of the magnitude of control pressure P2, in a manner as will be described later in the text. This constant flow of fluid passes through the controller **66*a*, which is interposed between the control pressure sensing circuit of flow control valve 10 and control space 66 of the pilot valve assembly 51. In a well known manner, for each specific position of the metering spool 113 a constant pressure differential, equal to ΔPx will be developed across the controller 66*a*. It is assumed, when describing the operation of the flow control valve of this invention, that with the metering spool 113** displaced all the way to the right, the pressure differential ΔPx becomes so small that the value of control pressure P2 approaches the value of Pwp or P1 pressure.

Assume that the valve spool 18 is displaced by the manual lever 106 from left to right by sufficient amount to connect with signal slot 33 the load chamber 23 with positive load sensing port 37, while the load chamber 23 is still isolated from the supply chamber 22. Assume also that the load chamber 23 is subjected to a positive load pressure Pwp. The load pressure Pwp transmitted to passage 72 will open the check valve 70, close the check valve 71 and will be transmitted through line **69*a* to the controller 66*a*. Assume that due to full displacement to the right of the metering spool 113 the pressure drop ΔPx becomes negligible. The load pressure Pwp will be then directly transmitted to control space 66 with P2 becoming Pwp pressure. Control space 66 is connected through the flow control section 87 with the system reservoir 15. In a well known manner, the flow control spool 93 will automatically assume a throttling position, throttling the fluid from control space 66 at Pwp or P2 pressure, by action of throttling slots 101, to a pressure, equivalent to the preload of spring 96. Therefore space 95 will be always maintained at a constant pressure as dictated by the preload in the spring 96. Space 95 is connected through passage 103, leakage orifice 102 and passage 104 with space 94, connected to system reservoir 15 by line 105. Therefore, with constant pressure differential automatically maintained across leakage orifice 102, a constant flow, at a certain preselected minimum level, will take place from space 95 and control space 66, irrespective of the level of Pwp or P2 pressure. With the controller 66*a* in a fully open position, equivalent to minimum resistance to flow, P2 pressure will always equal Pwp pressure. The pilot valve spool 54 is subjected to Pwp pressure in the control space 66, preload of the pilot valve spring 68 and pressure P1p in annular space 64, which is connected by line 81 to the supply chamber 22, which in turn is connected, through throttling slots 45, with the inlet chamber 44, connected by discharge line 43 to the pump 12. Under the action of those forces the pilot spool 54 will move into a modulating position, as shown in FIG. 1, regulating the pressure in the control space 49 and therefore position of the control spool 40, throttling by throttling edges 46 the fluid flow from the inlet chamber 44 to the supply chamber 22, to maintain a constant pressure differential between annular space 64 and control space 66, equivalent to preload of the pilot valve spring 68. The free floating piston 55, subjected to pressure differential between annular spaces 64 and 63, will move all the way to the left, out of contact with the pilot spool 54. Since the supply chamber 22 is closed by position of the valve spool 18 from the load chamber 23 the control spool 40 will assume a position, in which throttling edges 46 will completely isolate the inlet chamber 44 from the supply chamber 22**.

Assume that the valve spool 18 is further displaced by the manual lever 106 from left to right, creating a metering orifice of specific area between the supply chamber 22 and the load chamber 23 through metering slot 29. Assume also that the load chamber 23 is subjected to a positive load pressure Pwp. Fluid flow will take place from the supply chamber 22, through created metering orifice, to the fluid motor 11, the pilot valve assembly automatically throttling, through the position of the control spool 40, the fluid flow from the inlet chamber 44 to the supply chamber 22, to maintain across created metering orifice a constant pressure differential of ΔPyp equal to ΔP, which in turn is equal to the quotient of the preload of the pilot valve spring 68 and the cross-sectional area of the pilot valve spool 54. Since a constant pressure differential is maintained across created metering orifice a constant flow of fluid will be supplied to fluid motor 11, irrespective of the variation in the magnitude of the load W. Therefore under those conditions the flow to the fluid motor 11 becomes directly proportional to the flow area of the created metering orifice and independent of Pwp pressure.

Assume that while controlling a positive load W, in a manner as described above, the metering spool 113 of the controller **66*a* was moved back into position, as shown in the drawing, creating a resistance to constant flow, by reduction in flow area of metering slots 114. Assume also that due to that resistance a pressure differential ΔPx is developed between annular spaces 115 and 116 of the controller 66*a*. Then the control space 66 will be subjected to P2 pressure which is equal to the difference between Pwp pressure and ΔPx. It can be seen that $\Delta Pyp = P1p - Pwp$, which is the pressure differential through created metering orifice, $P1p - P2 = \Delta P$, which is the constant pressure differential caused by the preload of the pilot valve spring 68 and that $Pwp - P2 = \Delta Px$. From the above three equations, when substituting and eliminating P1p, Pwp and P2 pressures, the basic relationship of $\Delta Pyp = \Delta P - \Delta Px$ is obtained. With $\Delta Px = 0$ which is the case, as explained above, when the controller 66*a* is in its fully open position, $\Delta Pyp = \Delta P$ and the flow through the created metering orifice to the fluid motor is controlled at maximum constant pressure differential. Any value of ΔPx, as can be seen from the basic equation, will automatically lower, by the same amount, ΔPyp, acting across created metering orifice, automatically reducing the quantity of fluid flow to the fluid motor 11, this flow still being maintained constant at a constant level and independent of the variation in the magnitude of load W. Therefore, by controlling the value of ΔPx, by the action of controller 66***a*, the pressure differential ΔPyp is controlled, controlling the velocity of load W. In a similar way the velocity of the load W and therefore the flow into the fluid motor 11 can be controlled by the variation in the area of the orifice created by displacement of the valve spool 18, at any controlled level of ΔPyp, as dictated by the value of ΔPx. Therefore the flow control system shown in the drawing becomes a dual input control system, in which one control input can be superimposed upon the other, providing a unique positive load control system. The control of ΔPx, by the controller 66*a*, is done in response to a pulse type control signal, supplied to the digital actuator assembly at a very low energy level from an electronic computing circuit, which can be a micro-processor 134.

Assume that the valve spool 18 is displaced by the manual lever 106 from left to right by sufficient amount to connect with signal slot 31 the load chamber 24 with negative load sensing port 35, while the load chamber 24 is still isolated from the outlet chamber 25. Assume also that the load chamber 24 is subjected to a negative load pressure Pwn. Then the pressure signal at Pwn pressure will be transmitted through passage 83 and line 82 to annular space 63 and react on the cross-sectional area of the free floating piston 55. Assume also that with communication between the load chamber 24 and the outlet chamber 25 closed no pressure signal is transmitted through line 69*a* and that control space 66 is subjected to reservoir pressure, by the action of flow control section 87. The pilot valve spool 54 will be displaced by the free floating piston 55 all the way to the right, connecting annular space 61 and the control space 49 with annular space 59, subjected to pump discharge pressure through line 76. The control spool 40 will automatically move all the way from right to left, with the throttling edges 41 cutting off communication between the exhaust chamber 42 and the outlet chamber 26 and therefore isolating outlet chambers 25 and 26 from the system reservoir 15.

Assume that the valve spool 18 is further displaced by the manual lever 106 from left to right, creating a metering orifice of specific area between the load chamber 24 and the outlet chamber 25, subjected to negative load pressure Pwn. Assume also that due to the full displacement to the right of the metering spool 113 the pressure drop ΔPx, induced by the regulated flow through the flow control 87, will be negligible. With the control spool 40 blocking the outlet chamber 26 from the exhaust chamber 42, the negative load pressure will be automatically transmitted through line 73, will open the check valve 71, close the check valve 70 and will be transmitted through line 69*a*, the controller 66*a* and line 69 to the control space 66. The P1 pressure in control space 66 will react on the cross-sectional area of pilot valve spool 54, the pilot valve spring 68 bringing it into its modulating position, as shown in the drawing and controlling the pressure in the control space 49, to establish a throttling position of the control spool 40, which will maintain a constant pressure differential across created metering orifice, as dictated by the preload of the pilot valve spring 68. Then Pwn−P2 will equal constant ΔP, which is equal to the quotient of the preload of the pilot valve spring 68 and the cross-sectional area of the pilot spool 54. Since a constant pressure differential of ΔPyn=ΔP is maintained across the created metering orifice, flow out of the fluid motor 11 will be proportional to the area of the created metering orifice and independent of the magnitude of the negative load W. Therefore in this way, by varying the flow area of the metering ofifice created by displacement of the valve spool 18, the velocity of the load W can be controlled, each area of orifice representing a specific constant flow level, independent of the magnitude of the load W.

Assume that while controlling a negative load W, in a manner as described above, the metering spool 113, of the controller 66*a*, was moved back into position as shown in the drawing, creating a resistance to constant flow by reduction in flow area of metering slots 114. Assume also that due to that resistance a pressure differential ΔPx is developed between annular spaces 115 and 116 of the controller 66*a*, resulting in ΔPx drop in P1 pressure. Therefore, P1−P2=ΔPx, Pwn−P2=ΔP and Pwn−P1=ΔPyn. When substituting and eliminating P1 and P2 and Pwn pressures, the basic relationship of ΔPyn=ΔP−ΔPx can be established. With ΔPx=0, which is the case with the controller 66*a* in its fully open position, as already described above, ΔPyn assumes its maximum constant value equal to ΔP. With the metering spool 113 in its throttling position, by controlling the value of ΔPx in response to pulse type control signal transmitted from the microprocessor 134, the value of ΔPyn can be controlled from maximum to zero, each constant value of ΔPyn, at any specific flow area of metering orifice created by displacement of the valve spool 18, representing a specific constant flow at a specific level from the fluid motor 11 and independent of the magnitude of the load W. Therefore the fluid control system as shown in the drawing represents a dual input control system, which will control, in an identical fashion, both positive and negative loads, while using a single pilot valve assembly 51. During control of positive load the free floating piston 55 is forceably maintained by a pressure differential out of contact with the pilot valve spool 54. During control of negative load the free floating piston 55 acts together with the pilot spool 54. During control of positive load the pressure differential, across the orifice created by displacement of the valve spool 18, is controlled by the throttling action of positive load throttling slots 45. During control of negative load the pressure differential, across the orifice created by displacement of the valve spool 18, is maintained by the throttling action of the negative load throttling slots 39. During the control of both positive and negative loads pressure differential, acting across created metering orifice can be varied by the controller 66*a*. Both for control of positive and negative loads and control system as shown in the drawing becomes a dual input control system in which the velocity of the load can be controlled either by variation in the area of the created metering orifice, or by variation in pressure differential acting across this orifice. Those two control signals can be superimposed one upon the other, providing a unique compensated flow control, independent of the magnitude of the positive and negative loads. While controlling positive and negative loads, through the variable pressure differential mode of control, a very low energy pulse type control signal can be used, making this control directly adaptable to the digital signal of electronic circuits.

The change in ΔPx and the resulting change in control pressure differential, across the metering orifice created by the displacement of the valve spool 18 of the flow control 10, is accomplished by change in position of the metering spool 113. The threaded shaft 125, interposed between the digital actuator in the form of a stepper motor 130 and the metering spool 113, translates the angular steps of the stepper motor 130 into discrete linear steps of the metering spool 113. The resistance to axial displacement of the metering spool 113 is so small, that a very fast and small stepper motor 130 can be used. The solid state logic switch 131 connects the stepper motor 130 to the source of electrical power while responding to low power pulse type signal from the pulse generator 133, and therefore acts as a type of amplifier. The pulse generator 133 responds directly to the digital signal from the micro-processor 134. The pulse pick-up 137 transmits pulse feedback directly to the micro-processer 134. This pulse feedback is very important since it not only provides the micro-processer 134 with the response capability of the stepper motor 130, but also permits to instantly detect any possible malfunction of the stepper motor.

The dual input control system, as shown in the drawing, permits through manual lever 106, manual control of the load W by the operator. Then the micro-processer 134 can superimpose its control upon the control action of the operator, so for example the work can be performed in minimum time, at maximum efficiency level and maximum safety for the operator and machine. In this way for example in a few hundredths of a second, the micro-processer 134, by increasing the value of ΔPx, can make the control pressure differential of the flow control valve 10 equal to zero, instantly stopping the load W.

While describing the operation of the dual input control system it was assumed that the valve spool 18 was either directly actuated by the operator through the manual lever 106, or remotely when a number of pulses in pulse signal 110 is made proportional to a manual input signal. Actually the pulse signal 110 might be transmitted from a pulse generator, responding directly to a digital signal from a micro-processer or micro-computer. In this case the flow control valve 10 becomes a dual input servo valve. The lost motion mechanism 107 is interposed between the digital pulse type actuator 108 which may be provided with a hydraulic amplifying stage and the valve spool 18. Such a lost motion mechanism, well known in the art, may be composed of a preloaded spring cartridge and permits full displacement of the valve spool 18, throughout its entire stroke, by the manual lever 106, irrespective of the position of the digital pulse type actuator 108, so that the operator at any time can assume full control of load W.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A dual input valve assembly supplied with pressure fluid by a pump, said dual input valve assembly comprising a housing having an inlet chamber, a supply chamber, first and second load chambers and exhaust means connected to reservoir means, first valve means for selectively interconnecting said load chambers with said supply chamber and said exhaust means, first control orifice means responsive to movement of said first valve means and operable to meter fluid flow between said supply chamber and said load chambers, second control orifice means responsive to movement of said first valve means and operable to meter fluid flow between said load chambers and said exhaust means, positive load fluid throttling means between said inlet chamber and said supply chamber, negative load fluid throttling means between said load chambers and said exhaust means, single pilot valve means having means responsive to pressure differential across said first and said second control orifice means and operable through said positive load fluid throttling means to throttle fluid flow from said inlet chamber to said supply chamber and also operable through said negative load fluid throttling means to throttle fluid flow from said load chambers to said exhaust means to maintain a constant pressure differential at a preselected constant level across said single pilot valve means and to maintain a constant pressure differential across said first and said second control orifice means, first pressure signal transmitting means operable to transmit control pressure signal from down stream of said first control orifice means to controller means, second pressure signal transmitting means operable to transmit control pressure signal from down stream of said second control orifice means to said controller means, said controller means having means operable through said single pilot valve means to vary the level of said constant pressure differential across said first and said second control orifice means in response to an electrical pulse type signal, while said pressure differential across said single pilot valve means remains constant at said constant predetermined level.

2. A dual input valve assembly as set forth in claim 1 wherein said controller means includes flow orifice means and a flow control means down stream of said flow orifice means.

3. A dual input valve assembly as set forth in claim 1 wherein said controller means includes fluid throttling means and flow control means down stream of said fluid throttling means.

4. A dual input valve assembly as set forth in claim 1 wherein said controller means has means to vary the level of said constant pressure differential across said first and said second control orifice means below the level of said pressure differential across said pilot valve means maintained constant at said single constant predetermined level.

5. A dual input valve assembly as set forth in claim 1 wherein said controller means has means responsive to an electrical pulse type signal.

6. A dual input valve assembly as set forth in claim 1 wherein said single pilot valve means has control force generating means responsive to pressure differential across said first control orifice means.

7. A dual input valve assembly as set forth in claim 1 wherein said single pilot valve means has control force generating means responsive to pressure differential across said second control orifice means.

8. A dual input valve assembly as set forth in claim 1 wherein said single pilot means has first control force generating means responsive to pressure differential across said first control orifice means and second control force generating means responsive to pressure differential across said second control orifice means.

9. A dual input valve assembly as set forth in claim 1 wherein said controller means has digital drive means responsive to an electronic computing means.

10. A dual input valve assembly as set forth in claim 1 wherein said controller means has stepper motor means and rotary to linear motion translating means.

11. A dual input valve assembly as set forth in claim 1 wherein said first valve means has manually operated actuating means.

12. A dual input valve assembly as set forth in claim 1 wherein said first valve means has actuating means having force generating means responsive to a pulse type electrical input signal.

13. A dual input valve assembly operable to control fluid flow to and from a fluid motor subjected to an opposing or aiding load, said valve assembly having first valve means operable to provide first and second control orifice means to meter fluid flow to and from said fluid motor, throttling control means operable to selectively throttle fluid flow to and from said fluid motor, single pilot means having means responsive to pressure differential across said first and said second orifice means and operable through said throttling control means to maintain a relatively constant pressure differential at a preselected constant level across said single pilot valve means and to maintain a constant pressure differential across said first and said second control orifice means during control of said opposing or said aiding load, first pressure signal transmitting means operable to transmit control pressure signal from down stream of said first control orifice means to controller means, second pressure signal transmitting means operable to transmit control pressure signal from down stream of said second control orifice means to said controller means, said controller means having means responsive to an electrical pulse type signal and means operable to modify said pressure signal transmitted from said first and said second signal transmitting means, whereby the level of said constant pressure differential acting across said first and second control orifice means can be varied with respect to said electrical pulse type signal while said pressure differential across said single pilot valve means remains constant at said constant predetermined level.

14. A dual input valve assembly as set forth in claim 13 wherein said controller means has digital drive means responsive to an electronic computing means.

15. A dual input valve assembly as set forth in claim 13 wherein said controller means has stepper motor means and rotary to linear motion translating means.

16. A dual input valve assembly as set forth in claim 13 wherein said first valve means has actuating means having force generating means responsive to a pulse type electrical input signal.

* * * * *